US010553188B2

(12) United States Patent
Li

(10) Patent No.: US 10,553,188 B2
(45) Date of Patent: Feb. 4, 2020

(54) MUSICAL ATTRIBUTION IN A TWO-DIMENSIONAL DIGITAL REPRESENTATION

(71) Applicant: CharmPI, LLC, Cambridge, MA (US)

(72) Inventor: Wu-Hsi Li, Somerville, MA (US)

(73) Assignee: CharmPI, LLC, Cambridge, MA (US)

( * ) Notice: Subject to any disclaimer, the term of this patent is extended or adjusted under 35 U.S.C. 154(b) by 0 days.

(21) Appl. No.: 15/854,006

(22) Filed: Dec. 26, 2017

(65) Prior Publication Data

US 2018/0182362 A1 Jun. 28, 2018

Related U.S. Application Data

(60) Provisional application No. 62/439,083, filed on Dec. 26, 2016.

(51) Int. Cl.

| | |
|---|---|
| ***A63H 5/00*** | (2006.01) |
| ***G04B 13/00*** | (2006.01) |
| ***G10H 1/00*** | (2006.01) |

(52) U.S. Cl.

CPC ..... *G10H 1/0025* (2013.01); *G10H 2210/125* (2013.01); *G10H 2220/121* (2013.01); *G10H 2220/131* (2013.01); *G10H 2240/021* (2013.01)

(58) Field of Classification Search

CPC ..... G10H 1/0025; G10H 2220/121; G10H 2240/021; G10H 2210/125; G10H 2220/131; G10H 2220/106; G10H 2220/126

USPC ..... 84/609

See application file for complete search history.

(56) References Cited

U.S. PATENT DOCUMENTS

| | | | | |
|---|---|---|---|---|
| 5,400,687 | A * | 3/1995 | Ishii | G09B 15/002 84/477 R |
| 5,690,496 | A * | 11/1997 | Kennedy | G09B 15/003 345/473 |
| 7,705,229 | B2 * | 4/2010 | Bancroft | G09B 15/00 84/470 R |
| 7,777,117 | B2 * | 8/2010 | Salter | G09B 15/00 84/470 R |
| 8,987,576 | B1 | 3/2015 | Baxter | |
| 9,196,170 | B2 | 11/2015 | Moll | |
| 9,230,526 | B1 * | 1/2016 | Cook | G10H 1/0033 |
| 9,355,487 | B2 | 5/2016 | Moll et al. | |
| 9,390,698 | B2 | 7/2016 | Ryckman et al. | |
| 2004/0070621 | A1 * | 4/2004 | Suzuki | G10H 1/0008 715/764 |

(Continued)

*Primary Examiner* — Jeffrey Donels

(74) *Attorney, Agent, or Firm* — Adams Intellex, PLC

(57) ABSTRACT

Musical attribution is performed in a two-dimensional (2D) digital representation. A piece of music representing a musical score is inputted. An abstracted representation of blanks of the score, called a digital audio canvas, is produced. Interactive, dynamic attribution is performed by a user to bring to life the musical score of abstracted blanks. Instrumentation selection, relative volume, scale selection, and score tempo are all musical attributes that are conveyed to the score of abstracted blanks. The score of the digital audio canvas is played back using the attributed blanks. The playback of the score is enabled by selecting appropriate abstracted blanks. The appropriate abstracted blanks are included among other blanks for increased educational and enjoyment value. The modified score is converted back into the format of the original inputted piece of music.

23 Claims, 13 Drawing Sheets

(56) References Cited

U.S. PATENT DOCUMENTS

| | | | | |
|---|---|---|---|---|
| 2004/0206225 | A1* | 10/2004 | Wedel | G09B 15/02 84/477 R |
| 2007/0175317 | A1* | 8/2007 | Salter | G10H 1/0025 84/609 |
| 2007/0245881 | A1* | 10/2007 | Egozy | G10H 1/0016 84/609 |
| 2008/0078281 | A1* | 4/2008 | Katsuta | G09B 15/00 84/609 |
| 2009/0308230 | A1* | 12/2009 | Kayama | G10H 1/0091 84/622 |
| 2013/0112062 | A1* | 5/2013 | Iriyama | G10H 1/0008 84/453 |
| 2014/0267310 | A1 | 9/2014 | Moll et al. | |
| 2015/0254903 | A1 | 9/2015 | Sumner et al. | |
| 2015/0294491 | A1 | 10/2015 | Nungester et al. | |
| 2015/0331657 | A1 | 11/2015 | Bancroft et al. | |
| 2015/0332367 | A1 | 11/2015 | Lozano | |
| 2016/0034056 | A1 | 2/2016 | Moll | |
| 2016/0217598 | A1 | 7/2016 | Grasso | |
| 2018/0174559 | A1* | 6/2018 | Elson | H04N 7/142 |
| 2018/0226063 | A1* | 8/2018 | Wood | G11B 27/031 |

* cited by examiner

MUSICAL ATTRIBUTION IN A TWO-DIMENSIONAL DIGITAL REPRESENTATION

RELATED APPLICATIONS

This application claims the benefit of U.S. provisional patent application "Musical Attribution in a Two-dimensional Digital Representation" Ser. No. 62/439,083, filed Dec. 26, 2016.

FIELD OF ART

This application relates generally to digital music attribution and more particularly to musical attribution in a two-dimensional digital representation.

BACKGROUND

Music has existed in many societies and in many forms for millennia. Music has been called an emotional language and provides a societal connection that goes beyond mere prose or unaccompanied poetry. There are many societal connections with music. For instance, music can be used to express feelings of pride or nationalism, such as when a country's national anthem is played; or it can be used to express solidarity with a sports team, such as when an alma mater is played during a college football game; or music can be used to express emotions of joy and excitement, such as when a bride walks down the aisle accompanied by music during a wedding ceremony. Music can also be an important component in learning and childhood development. Many elementary schools include music programs, and the benefits of music education for children are well documented. In addition, experimenting with music is an enjoyable activity. Music is defined and characterized by tones, pitches, and durations. Tones, or notes, are associated with a musical pitch, or frequency. The duration of a note specifies the length of time that a note is sounded. Furthermore, a specific note quality, or timbre, can be associated with each note. It is common for timbre of digital music to correspond to a live instrument, such as a piano, trumpet, or saxophone. The various components of a musical note can be called its attributes.

The musical attributes of a piece of music can be communicated in several ways. One common way to express musical notation is to use staff nomenclature where notes are represented as marks on a series of lines which represent one or more octaves of a musical scale. Such representations are often called sheet music. Sheet music that represents musical expression for instruments in the context of a band or orchestra is often called a musical score. A sheet music score can be used to represent complex musical arrangements played by over hundreds of instruments in a large orchestra. The instruments each contribute to the melody, harmony, and rhythm of a musical piece according to the dictates of the composer or arranger. Of course, technology can be used to allow for digital representation of music. There are many forms of digital representation of music, such as the .wav format used on digital optical discs. Another common format is the .mp3 format used for compressed digital storage and transmission. Musical scores can be captured in a musical instrument digital interface file, or .midi or .mid, format.

Digital music can, of course, be played back. That is, it can be converted from digital ones and zeros in a file format into an audio tone played through a loudspeaker, headphones, or earbuds. Various attributes of the playback can be controlled. These attributes include volume, which corresponds to the amplitude of a resulting sound pressure wave, and equalization, which corresponds to the relative amplitude of various frequency ranges within the audio frequency range, such as a bass boost or a treble cut. Other attributes such as tempo and instrumental emphasis can be controlled during playback as well.

SUMMARY

Interactive, dynamic, digital music attribution provides an exciting educational and recreational way to enjoy music. Music can be represented on a digital device in a two-dimensional (2D) graphical representation that provides music creation opportunities through digital musical attribution and playback. Attribution allows a musical piece to enable playback at various tempos, with various instrumental voices, and with musical scale transposition. The attribution can be accomplished through dynamic, manual manipulation of note representations, called blanks, on the graphical interface of a digital device. Color can be used to represent instrumentation, and the hue, or saturation and value, of the color can be used to represent emphasis. The size of a blank can be used as to indicate the note's length of musical time, such as a quarter note or a half note. The vertical positioning of a blank can be used to indicate the tonal frequency or pitch of a note.

A piece of music can be represented in sheet music format, which includes notes with various fills and appendages to signify duration and relative position on one or more musical clefs, such as a treble clef or a bass clef, to signify tone. Interactive, dynamic digital music attribution can be accomplished using a 2D graphical interface that has a digital representation of a musical score which was input and converted from sheet music format or another suitable format, such as a .midi file or an .mp3 file. The represented music has 2D shapes, called blanks, which represent the notes. The blanks can be filled in by clicking and/or dragging attributes, such as color, from a palette of colors representing various instruments to the blank. The attributing can be accomplished using a mouse, cursor, stylus, or even the finger of a child. The attributing can be changed at will in a dynamic and interactive fashion through a 2D graphical representation with a graphical user interface (GUI). Since musical representation might often exceed the screen dimensions to display an entire piece of music, the 2D graphical interface can be scrolled forward or backward to allow attribution and re-attribution along the entire piece of music.

Playing an attributed musical representation can be enabled using a selecting process. The selecting can be accomplished on the 2D graphical representation GUI. The blanks can be transformed into a series of shapes, each of which can be the same certain, recognizable nature element. The recognizable nature elements can be selected on the GUI to enable playback of the musical representation. The certain, recognizable nature elements can be sized and/or rotated to represent tone duration. In addition, other recognizable nature elements can be interspersed with the certain, recognizable nature elements to make the selecting more difficult. A threshold can be set to determine how many of the shown, same certain, recognizable nature elements must be selected in order to enable playback of the attributed musical representation.

A computer-implemented method for graphical music manipulation comprising: obtaining, on a first digital device, a musical score; representing, on a second digital device, the musical score on a two-dimensional (2D) graphical interface, wherein the 2D graphical interface includes a plurality of notes represented by a plurality of blanks; attributing, on a third digital device, the musical score with one or more musical properties, wherein the one or more musical properties are associated with a first blank from the plurality of blanks; and playing, using speakers coupled to the third digital device, the musical score, wherein the playing is controlled using the one or more musical properties associated with the first blank from the plurality of blanks. In embodiments, the method further comprises attributing the musical score with an additional one or more musical properties, wherein the additional one or more musical properties are associated with a second blank from the plurality of blanks. In embodiments, the method further comprises playing the musical score using the one or more musical properties associated with the first blank and the additional one or more musical properties associated with the second blank. In embodiments, the blanks comprising the musical score have shapes of a first recognizable nature element.

Various features, aspects, and advantages of various embodiments will become more apparent from the following further description.

BRIEF DESCRIPTION OF THE DRAWINGS

The following detailed description of certain embodiments may be understood by reference to the following figures wherein.

DETAILED DESCRIPTION

Figure 1:
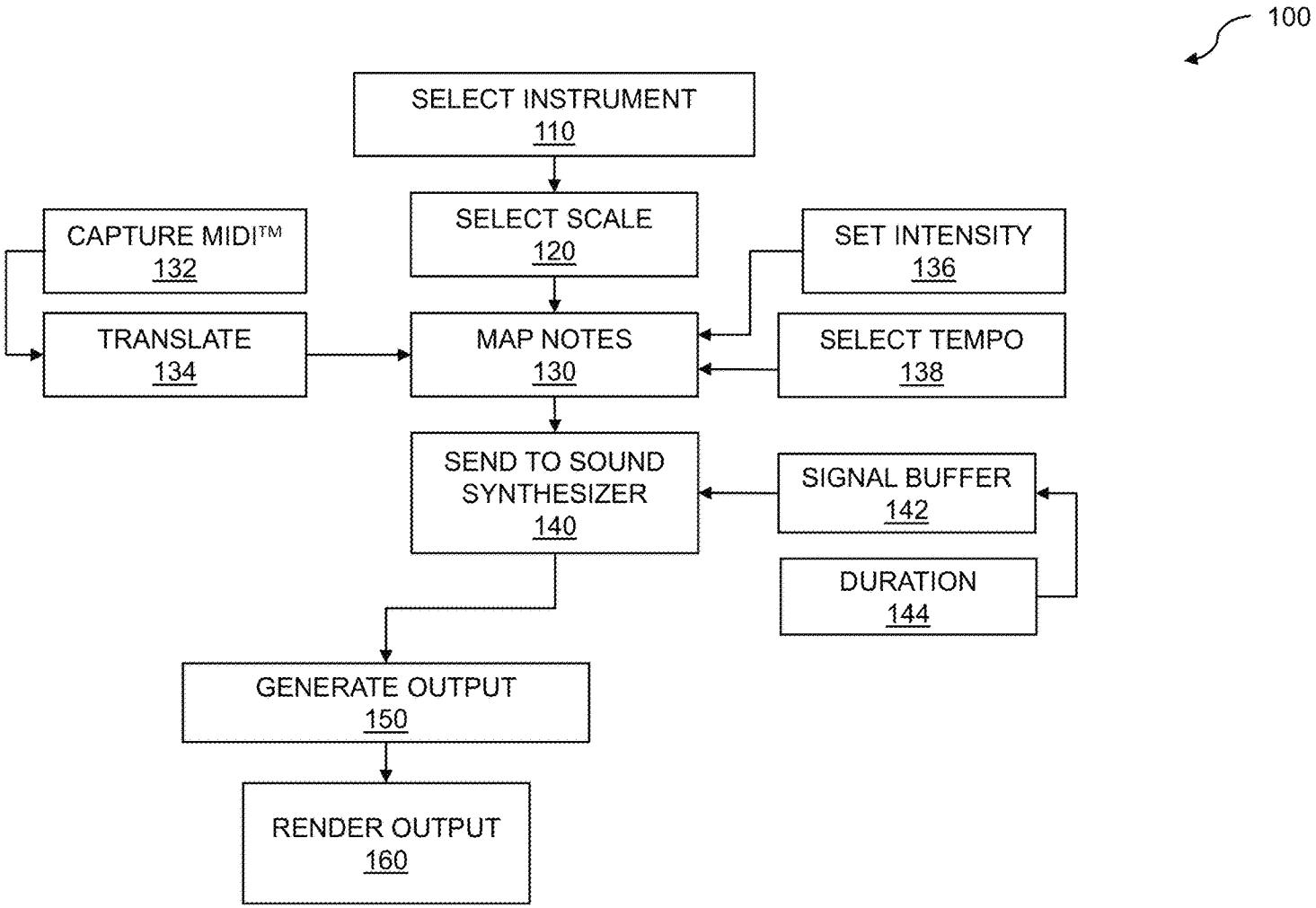
FIG. 1 is a flow diagram for user interface operation.

The dynamic, interactive attribution of digital music using a two-dimensional (2D) digital graphical interface is described. While music can be created and arranged by various means, the resulting musical representation is very limited in providing for dynamic manipulation. Therefore, a need exists for taking existing music in the form of, for example, sheet music, and manipulating the music interactively to alter its characteristics—sometimes in such a way as to render it unrecognizable when compared to its original sound. Furthermore, a great need exists for such attribution to be accessible and easily performed by someone such as a child, for whom the benefit of musical interaction and learning is simultaneously fun and educational. Disclosed embodiments accomplish accessible music ingestion, attribution, and playback, with the benefit of supporting dynamic attribution alteration and re-attribution. The resultant attribution can be rendered into an output format, such as sheet music or a digital file. The disclosed embodiments of the two-dimensional (2D) graphical interface thus comprise a digital musical coloring book.

Attribution is accomplished through a graphical, preferably touch-sensitive, 2D interface. Musical notes are represented by 2D outline shapes, called blanks, which abstract the commonplace note nomenclature of standard sheet music into a 2D x-y mapping where vertical position represents relative note pitch, horizontal position represents note sequence, and horizontal shape extension represents relative note duration. The abstraction provides a musical canvas onto which various attributes can be drawn. Intentionally missing from the abstraction are specific indications of absolute note pitch and absolute note duration. There is no time signature, key signature, or tempo indicator. For example, a simple musical scale can be abstracted into blanks, but whether the scale would play as a major scale using slow (e.g. whole) notes or as a minor scale using fast (e.g., eighth) notes would be determined by musical attribution.

Furthermore, while there is no instrumentation indicated in the abstracted blanks, opportunity exists to dynamically attribute the blanks with instruments by clicking on or dragging a color—representing an instrument—to the blank from a palette of colored instruments. In this way, sophisticated musical attribution can even be accomplished by the finger of a young child. In this way, the child would experience a musical coloring book with which to experiment, learn, and enjoy. A next level of sophistication can be accomplished by emphasizing the musical part of a particular instrument during a particular section of the music. The emphasized instrumental part can be represented by a darkened hue of the chosen instrument's color. For example, trumpets are often chosen to play the melody line of a march in a typical musical arrangement or score. However, the melody line could be attributed to be a different instrument, such as an electric guitar, which could be represented by a green color. The attribution could then be changed to greatly emphasize the now-guitar part, which would be represented by a very deep and dark green. The color representation superimposed on the abstracted blanks provides a quick, accurate visual descriptor that can be easily identified, selected, and re-attributed as desired.

The abstracted musical score, or canvas, can be finalized for playback and/or rendering to a format suitable for further, future use. Playback tempo can be adjusted in real time. Playback tempo can be adjusted in a linear fashion, such that the absolute duration of every blank is proportional to the blank size, or in a non-linear fashion, such that the absolute duration of every blank changes depending on the section of the musical score being played. Playback of absolute note pitch can be adjusted as well using a scale selection graphical user interface (GUI). A musical piece originally written in a major scale but subsequently played back, at least in part, in a minor scale provides for a very different sequence of absolute musical pitches and can give a piece an altogether different sound. Choosing a less well-known scale for a particular culture, such as substituting a Chinese scale for a traditionally Western musical piece can, along with selecting non-traditional instrument attribution and emphasis, would render a familiar piece practically unrecognizable.

An additional educational and entertaining aspect of the current invention is found in enabling the playback of the attributed musical representation by an interactive selection of the correct blanks. The blanks can be transformed into a series of shapes, each of which can be the same certain, recognizable nature element. For example, each of the blanks comprising the musical score can be transformed into a plant or animal of the user's choosing, such as a shrimp. Alternatively, the digital musical coloring book can randomly assign a plant or animal. The shrimp-shaped blanks can then be selected on the GUI to enable playback of the musical representation. The shrimp-shaped blanks can be sized and/or rotated to represent tone duration. In addition, other recognizable nature elements can be interspersed with the shrimp. For example, a sea animal theme can be chosen to allow other fish and sea life to fill in around the shrimp-shaped blanks. Thus the educational and entertaining elements of the digital coloring book are enhanced by requiring discrimination between the certain, recognizable nature element, in this case a shrimp, and other related nature elements.

Musical attribution is performed in a two-dimensional (2D) digital representation. A piece of music representing a musical score is inputted. An abstracted representation of blanks of the score, called a digital audio canvas, is produced. Interactive, dynamic attribution is performed by a user to bring to life the musical score of abstracted blanks. Instrumentation selection, relative volume, scale selection, and score tempo are all musical attributes that are conveyed to the score of abstracted blanks. The score of the digital audio canvas is played back using the attributed blanks. The playback of the score is enabled by selecting appropriate abstracted blanks. The appropriate abstracted blanks are included among other blanks for increased educational and enjoyment value. The modified score is converted back into the format of the original inputted piece of music.

FIG. 1 is a flow diagram for user interface operation. The flow 100 includes selecting an instrument 110 to be used for attribution. Any number of instruments can be included for selection, such as a banjo, a piano, a violin, a guitar, and drums, to name just a few. The flow 100 also includes selecting a scale 120. A number of scales can be included for selection, such as a major scale and a minor scale, to name just two. Instrument selection and scale selection are discussed further in the FIG. 8 and FIG. 9 sections. The flow 100 includes mapping notes 130. The note mapping can be determined by a number of factors. The note mapping can include capturing a MIDI™ musical representation 132 and translating the captured MIDI™ file 134 into an abstracted, musical canvas of blanks which serves as the basic musical input into the attribution process. Furthermore, the note mapping can include different musical instruments set to different intensities 136. The note mapping can also include the selection of a musical tempo 138. The selecting and setting of various attributes can be done repeatedly and in any order. The selecting and setting can be done dynamically through a touch-sensitive GUI. Re-attribution can be accomplished any number of times.

In the flow 100, the mapped notes can be sent to a sound synthesizer 140. The sound synthesizer can generate a certain quality note based on any or all of the attributes of the mapped notes, and it can include buffering a signal 142 based on including a note duration 144. The flow 100 can include generating output 150 from the sound synthesizer 140. The output can be in the form of electrical signals which drive an audio transducer such as speakers or earbuds. The output can be in the form of a .midi file which output can be rendered 160 into a visible output format, such as sheet music. The flow 100 can be accomplished using a digital device with a 2D graphical interface. In some embodiments, the digital device is a tablet computer with a touch-sensitive screen allowing easy digital manipulation via a mouse, stylus, or finger. In some embodiments, the digital device is a cell phone, a desktop computer, or a digitally connected wrist device.

The flow 100 describes how a user can interface with digital musical attribution. The digital music score can be represented on a 2D graphical interface such as a musical canvas or coloring book, or blank score. A plurality of blanks of various positions and sizes can represent a plurality of notes to be attributed from a musical score. A default attribution can be included for any blanks not explicitly attributed by the user. The playing the musical score can include playing a duration of a blank from the plurality of blanks based on a size of the blank. The playing the musical score can include playing a tone of a blank from the plurality of blanks based on a vertical position of the blank. The playing the tone can correspond to an audio frequency. The audio frequency is often described as the pitch of a note.

Embodiments of flow 100 comprise a computer-implemented method for graphical music manipulation comprising: obtaining, on a first digital device, a musical score; representing, on a second digital device, the musical score on a two-dimensional (2D) graphical interface, wherein the 2D graphical interface includes a plurality of notes represented by a plurality of blanks; attributing, on a third digital device, the musical score with one or more musical properties, wherein the one or more musical properties are associated with a first blank from the plurality of blanks; and playing, using speakers coupled to the third digital device, the musical score, wherein the playing is controlled using the one or more musical properties associated with the first blank from the plurality of blanks. In some embodiments, the first digital device and the second digital device are a common device. In other embodiments, the second digital device and the third digital device are a common device. In other embodiments, the first digital device and the third digital device are a common device. In yet other embodiments, the first digital device, the second digital device, and the third digital device are all a common device. A common device comprises a digital device with substantially the same physical processor hardware, such as a computer processor semiconductor chip with one or more cores, or a computer processor multichip module housing one or more instances of a common processor semiconductor chip or two or more instances of complementary computer processor semiconductor chips, or a physically distinct server computer system or server computer building block, such as a rack-mounted server computer. Various steps in the flow 100 may be changed in order, repeated, omitted, or the like without departing from the disclosed concepts. Various embodiments of the flow 100 can be included in a computer program product embodied in a non-transitory computer readable medium that includes code executable by one or more processors.

Figure 2:
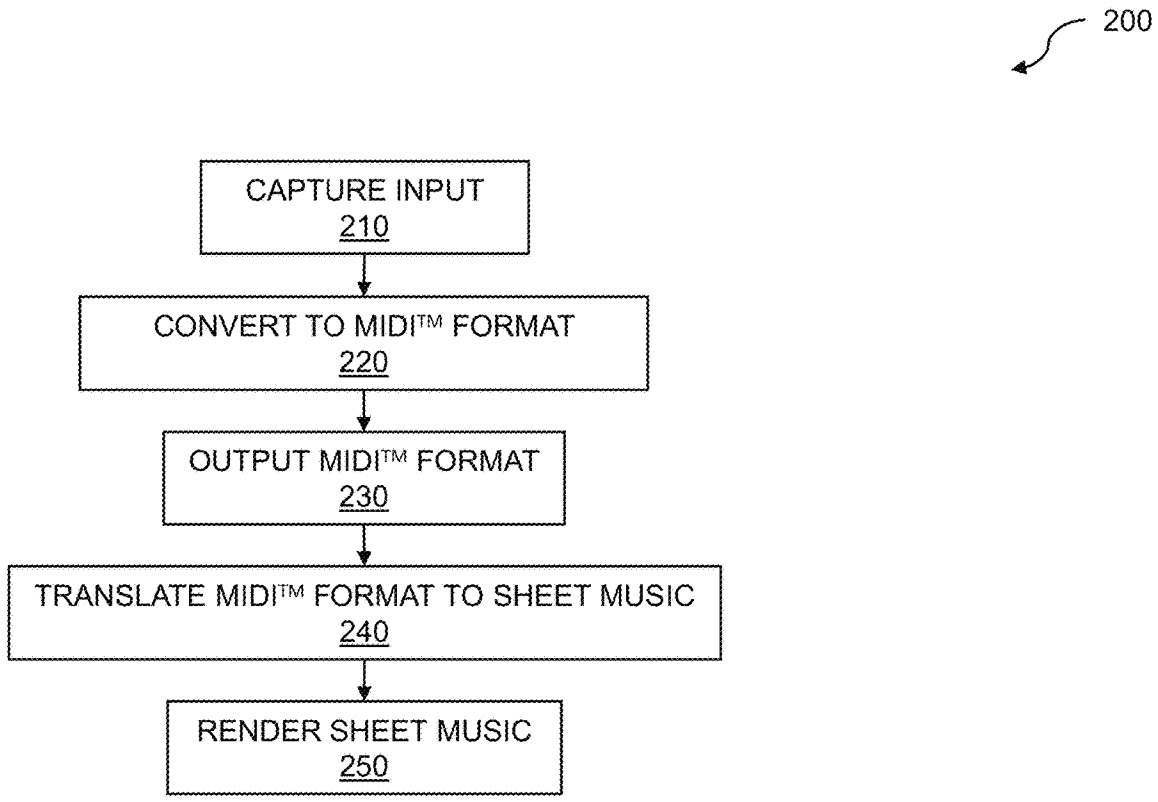
FIG. 2 is a flow diagram for MIDI™ to sheet music translation.

FIG. 2 is a flow diagram for MIDI™ to sheet music translation. The flow 200 includes capturing input 210. The input can be in various forms, such as sheet music form, .midi file form, or .mp3 file form, to name just a few. The flow 200 includes converting input, such as sheet music, into MIDI™ format 220. The MIDI™ format is available for 2D graphical representation and attribution, as was described in FIG. 1. The flow 200 includes outputting an attributed musical score in a MIDI™ format 230. The output MIDI™ format can be translated to sheet music 240. The sheet music can be rendered to a visible format 250. The visible format can be on a graphical display or in hardcopy format.

The flow 200 provides an input/output framework for music attribution. Standard formats, such as sheet music or MIDI™ can be useful for capturing and communicating created music. However, there are gross deficiencies in trying to use either for 2D graphical music attribution. Both sheet music and MIDI™ formats are precise representations of a musical piece. They both express the absolute note pitch, instrumentation, timing, and relative loudness of a musical piece. While absolute musical representation is helpful for the musical precision required for an orchestra to faithfully perform a piece of music, an abstracted musical representation is helpful to facilitate dynamic, interactive musical attribution and manipulation. Therefore the flow 200 provides a way to include standard musical representations around a flexible, dynamic musical attribution manipulation canvas. Various steps in the flow 200 may be changed in order, repeated, omitted, or the like without departing from the disclosed concepts. Various embodiments of the flow 200 can be included in a computer program product embodied in a non-transitory computer readable medium that includes code executable by one or more processors.

Figure 3:
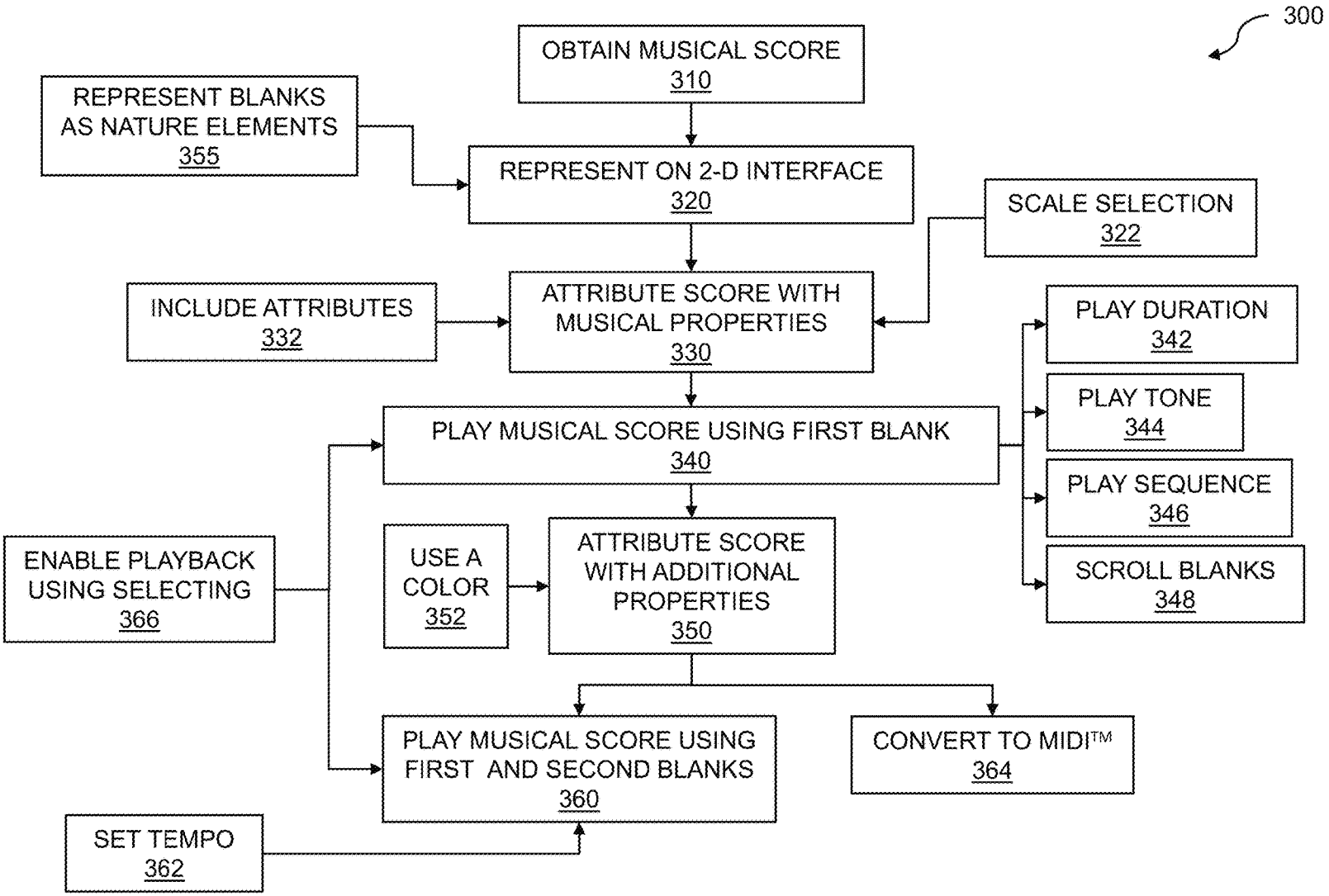
FIG. 3 is a flow diagram for graphical music manipulation.

FIG. 3 is a flow diagram for graphical music manipulation. The flow 300 includes obtaining a musical score 310. The score can be in any of several suitable input formats, such as sheet music format. The flow 300 includes representing the musical score on a two-dimensional (2D) graphical interface 320, wherein the 2D graphical interface includes a plurality of notes represented by a plurality of blanks. The blanks are 2D shapes and represent an abstracted version of the notes, where absolute pitch and duration are abstracted by relative blank vertical location and relative blank horizontal size, respectively. The flow 300 includes attributing the musical score with one or more musical properties 330, wherein the one or more musical properties are associated with a first blank from the plurality of blanks. The attributes can be included 332 with one or more of many different attributes, such as instrument voicing, instrument relative loudness, selection of a musical scale 322, and so on. The attributes can be added by a user using the graphical interface. The 2D graphical interface for graphical music manipulation can comprise a digital audio canvas.

The flow 300 includes playing the musical score using the one or more musical properties associated with the first blank 340 from the plurality of blanks. The playing of the musical score can include playing duration 342, playing tone 344, playing sequence 346, and scrolling blanks 348. The duration can be a function of the relative horizontal size of the blank and a selected tempo. The tone can be a function of the relative vertical position of the blank and a selected scale can be either harmonic or inharmonic and be a function of a musical instrument selected. The sequence can be a function of the relative horizontal position of the blank within multiple blanks of a series in time. The scrolling blanks can be a function of which blank along the horizontal axis is being played such that the currently played blank remains on screen even while the music flows across the screen. Therefore, in the flow 300, the plurality of attributes includes duration, tone, and sequence.

The flow 300 includes attributing the musical score with an additional one or more musical properties 350, wherein the additional one or more musical properties are associated with a second blank from the plurality of blanks. The attribution can include using a color 352 in the 2D graphical representation to indicate the presence of a musical attribute. The flow 300 includes representing blanks as nature elements 355. The nature elements can be recognizable nature elements that are especially recognizable for a child. For example, a sea creature themed nature element can be used, with a shrimp as the certain, recognizable nature element. Thus all blanks associated with the musical score are attributed with the same certain, recognizable nature element, in this case, shrimp. Additional, non-musical score blanks can be added to the 2D representation in the form of other, non-certain recognizable nature elements. For example, the musical score shrimp-shaped blanks can be obfuscated with other sea creature-themed, non-shrimp blanks, such as dolphins, crabs, octopi, and so on. In embodiments, the blanks comprising the musical score have shapes of a first recognizable nature element. In embodiments, the first recognizable nature element is a plant or animal. Some embodiments further comprise adding additional blanks in shapes of one or more additional recognizable nature elements. In embodiments, the additional blanks do not comprise a musical score. Some embodiments further comprise enabling the playing by selecting the first recognizable nature elements. And some embodiments further comprise disabling the playing by selecting one or more of the additional recognizable nature elements.

The flow 300 includes enable playback using selecting 366. The selection of the musical score nature elements, in this case, shrimp, enable the playback of the musical score with the attribution thus far selected. The selection of the appropriate shrimp-attributed blanks can be made on the 2D representation with a finger (on a touch screen), a mouse, a cursor, voice control, and so on. A selection enablement requirement can be set as 100% accuracy, a less-than-100% accuracy, a minimum number correct and/or a maximum number incorrect, 0% accuracy, and so on.

The flow 300 includes playing the musical score using the one or more musical properties associated with the first blank and the additional one or more musical properties associated with the second blank 360. The playing the musical score using the first blank 340 or the playing the musical score using the first and second blanks 360 can include enabling playback using selecting 366. The first and second blanks can be represented as nature elements 355. The flow 300 includes setting a tempo 362 to play the musical score. The flow 300 includes converting the attributed musical score to MIDI™ or other format 364. The flow 300 includes a plurality of attributes on the plurality of blanks. Thus the flow 300 describes a computer-implemented method for graphical music manipulation. Various steps in the flow 300 may be changed in order, repeated, omitted, or the like without departing from the disclosed concepts. Various embodiments of the flow 300 can be included in a computer program product embodied in a non-transitory computer readable medium that includes code executable by one or more processors.

Figure 4:
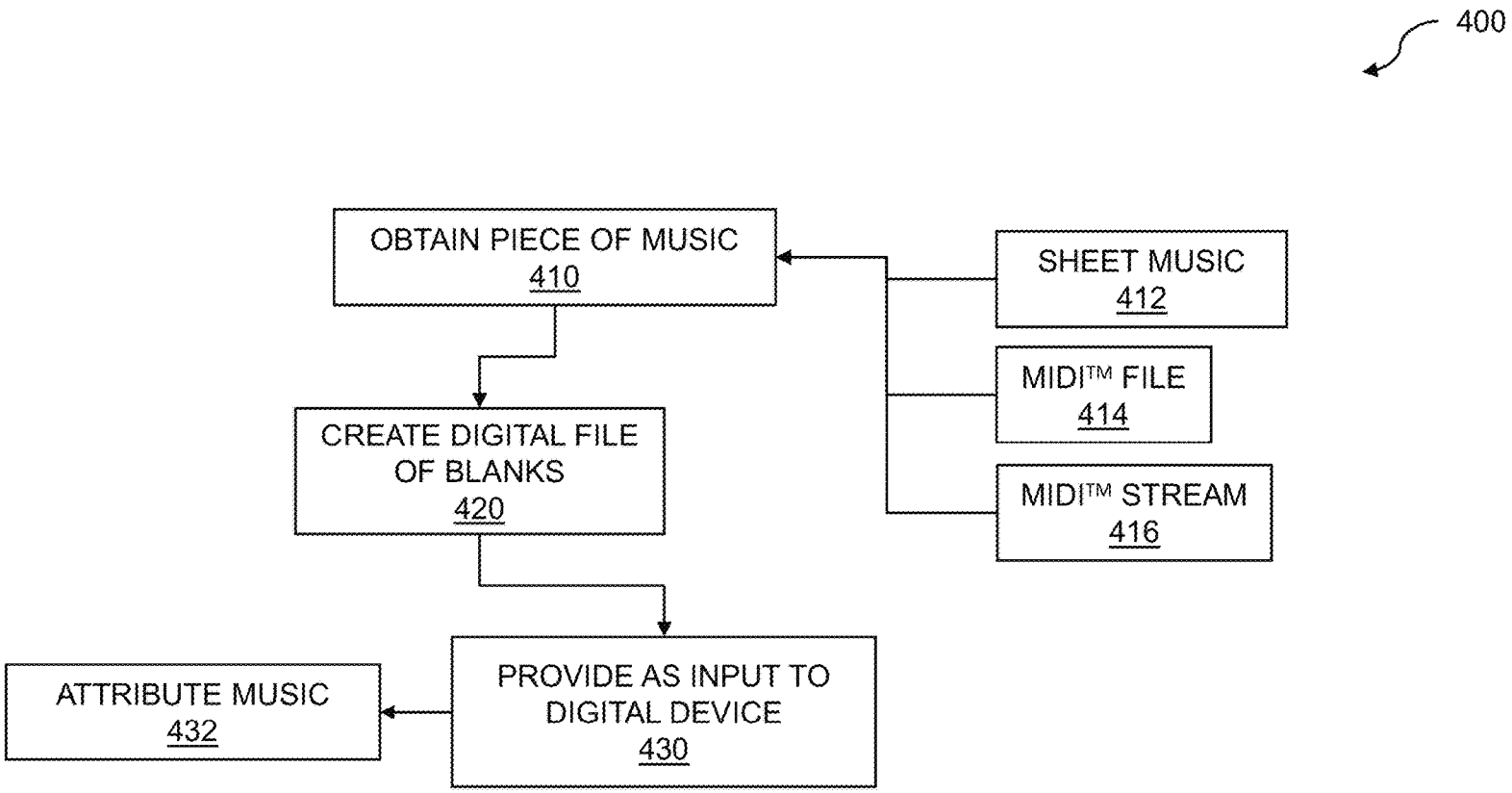
FIG. 4 is a flow diagram for graphical music manipulation input and conversion.

FIG. 4 is a flow diagram for graphical music manipulation input and conversion. The flow 400 includes obtaining a piece of music 410. The piece of music can be obtained from any of several suitable input formats. The flow 400 can include obtaining a musical score from sheet music 412. The flow 400 can include obtaining a musical score from a MIDI™ input file 414. The flow 400 can include obtaining a musical score from a MIDI™ digital stream 416. The flow 400 includes creating a digital file of blanks 420, where the digital file represents the piece of music and wherein the blanks are represented in the digital file such that blank size corresponds to note duration, blank vertical position corresponds to note musical pitch, and blank horizontal position corresponds to note sequence. Thus the blanks represent an abstraction of the musical input, in which the piece of music is in the form of a sheet music 412, a MIDI™ input file 414, or a MIDI™ digital stream 416.

The flow 400 includes providing the digital file as input to a digital device 430 comprising a two-dimensional (2D) graphical interface, wherein the 2D graphical interface provides for attributing the music 432. The digital device can be a tablet computer with a touch-sensitive surface for dynamic, interactive attribution. Many other suitable digital devices can be used, such as a smart phone, a desktop computer, a digital communication watch, a set of virtual reality (VR) goggles, and so on. A mouse, stylus, or another pointing device can be used in place of the touch-sensitive display surface. Thus the flow 400 describes a computer-implemented method for graphical music manipulation. In embodiments, computer-implemented method for graphical music manipulation comprise: obtaining a piece of music; creating a digital file of blanks, where the digital file represents the piece of music and wherein the blanks are represented in the digital file such that blank size corresponds to note duration, blank vertical position corresponds to note musical pitch, and blank horizontal position corresponds to note sequence; and providing the digital file as input to a digital device comprising a two-dimensional (2D) graphical interface, wherein the 2D graphical interface provides for attributing the music. Various steps in the flow 400 may be changed in order, repeated, omitted, or the like without departing from the disclosed concepts. Various embodiments of the flow 400 can be included in a computer program product embodied in a non-transitory computer readable medium that includes code executable by one or more processors.

Figure 5A:
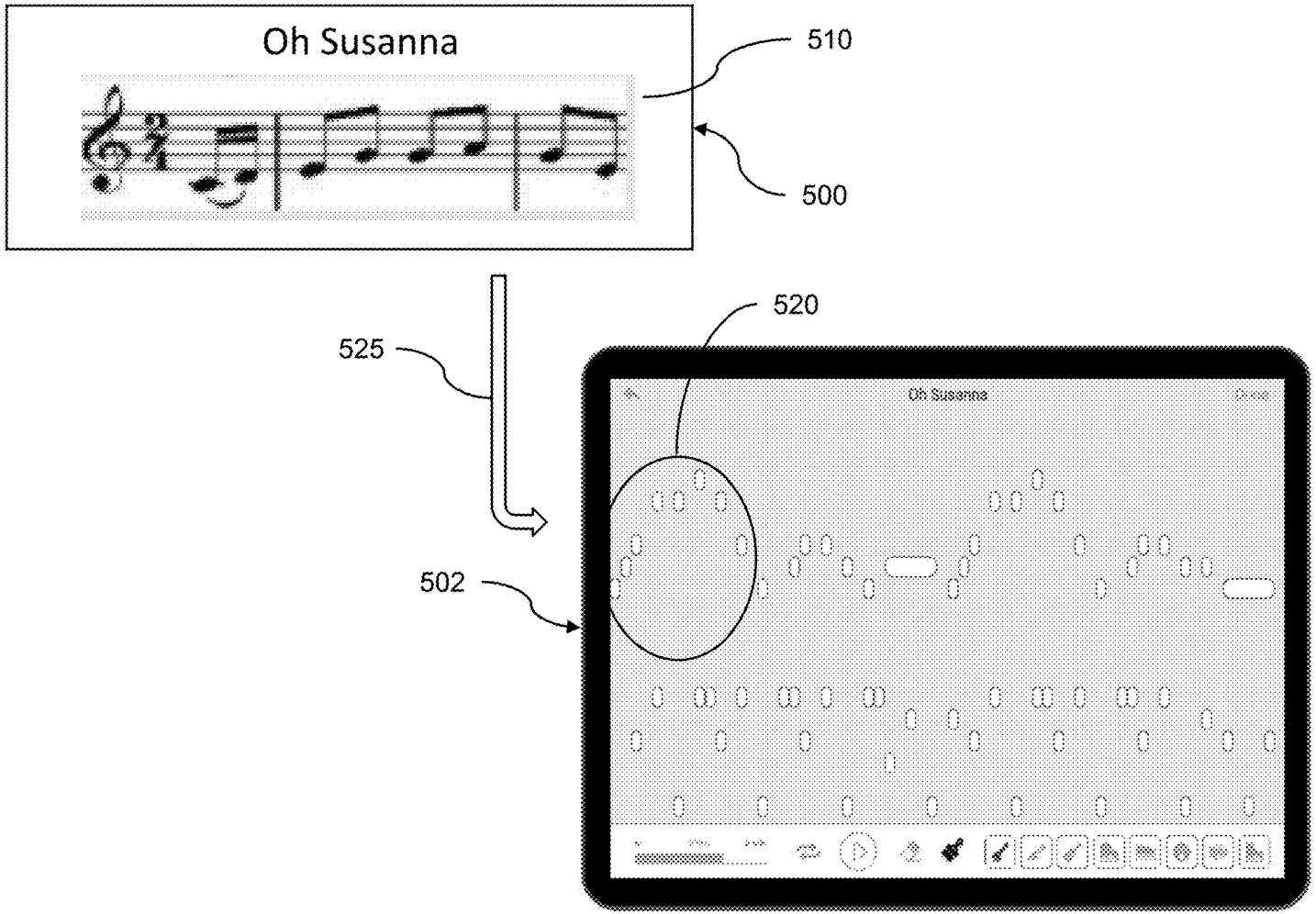
FIG. 5A is an example music score and digital canvas.

FIG. 5A is an example music score and digital canvas. The music score 500 can be in a traditional clef nomenclature 510 format. In traditional clef nomenclature, note pitches and durations are described in absolute terms. Note pitches are described by oval note representations, consistently sized, along two sets of five parallel lines which typically comprise a staff made of a treble clef (as shown in clef nomenclature 510 format) and a bass clef (not shown). The pitch is also influenced by the key signature, which is determined by the number of sharp or flat symbols at the beginning of each clef of each staff. For example, if a note is present in the space between the second and third lines from the bottom of the treble clef, the pitch is defined to be a concert "A" note, which is an audio waveform of 440 Hz. The pitch is an absolute tone described by a measured physical value and is not relative in any sense. Similarly, an input MIDI™ file has a representation of the concert "A" note which is likewise absolute. Note durations are described via oval note coloration, appendage (stem), and whether a dot immediately follows the note. The note duration is also described by a time signature and a tempo. These factors taken together determine the absolute duration of the note. For example, a colored-in oval with a single stem and no dot is a quarter note. If the time signature is "¾" and the tempo is 100 (beats per minute), the absolute duration of the note is 1 beat @ 100 beats/60 seconds=600 ms duration. While musicians and/or a conductor certainly has the flexibility to play and/or lead a band or orchestra to play notes differently in duration from what is written in the score, nonetheless, traditional musical nomenclature is precise and absolute in representing a piece of music.

A digital canvas 502 shows an example abstraction of musical blanks 520 which correspond to the music score 500. In this case, the music score 500 represents, partially, the traditional folk song, "Oh Susanna." Each of the blanks in the plurality of musical blanks 520 corresponds relatively to a note on the music score clef nomenclature 510. The musical blanks 520 correspond in vertical position and horizontal separation on a one-to-one basis according to the absolute note pitch and duration indicated by the music score 500 through transformation 525. That is, each note of score 500 has its pitch and duration transformed into a blank on the 2D representation. Thus, the digital canvas comprises a two-dimensional (2D) graphical interface, and the two-dimensional (2D) graphical interface can include a digital musical coloring book. The abstraction provided by the digital canvas enables dynamic, interactive musical attribution.

Figure 5B:
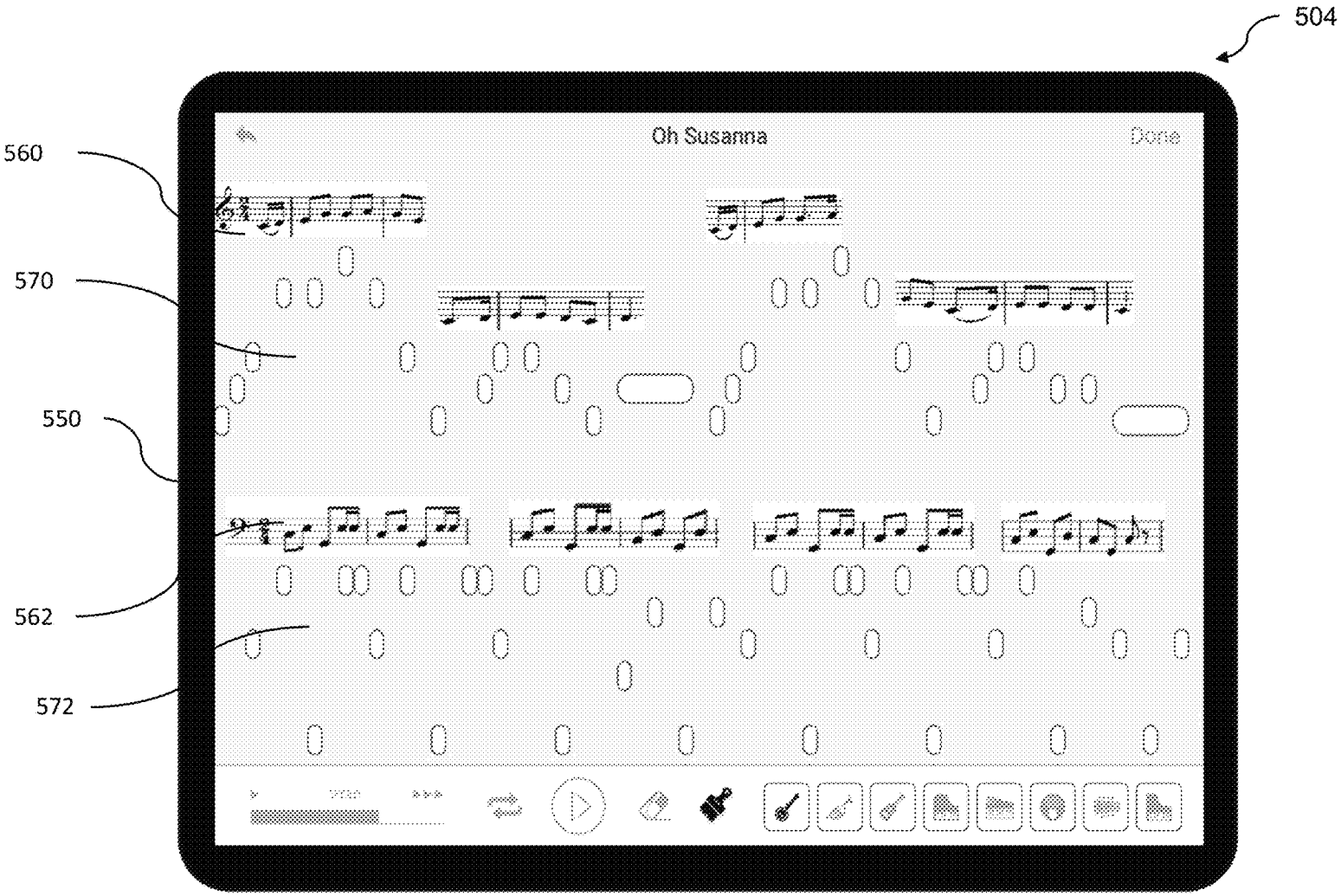
FIG. 5B is an example digital canvas with a representative, superimposed musical score.

FIG. 5B is an example digital canvas with a representative, superimposed musical score. The example 504 highlights a digital canvas 550 employing a 2D graphical music representation, which shows a treble clef music score 560 in traditional nomenclature superimposed over the abstracted upper blank canvas 570 corresponding to the traditional score. Likewise, a bass clef music score 562, also in traditional nomenclature, is superimposed over an abstracted lower blank canvas 572. For the upper blank canvas 570 and the lower blank canvas 572, the vertical position can include a plurality of musical octaves. The plurality of musical octaves can be discontinuous. The plurality of musical octaves can vary within the musical score. The blanks representing the music score can be attributed and played. The playing the musical score can include playing a sequence of blanks from the plurality of blanks based on a horizontal position of the sequence of blanks. The sequence of blanks can correspond to note timing. Note duration can be indicated by space between successive blanks, the horizontal and/or vertical size of each blank, or both the space between successive blanks and the size of each blank.

Figure 6A:
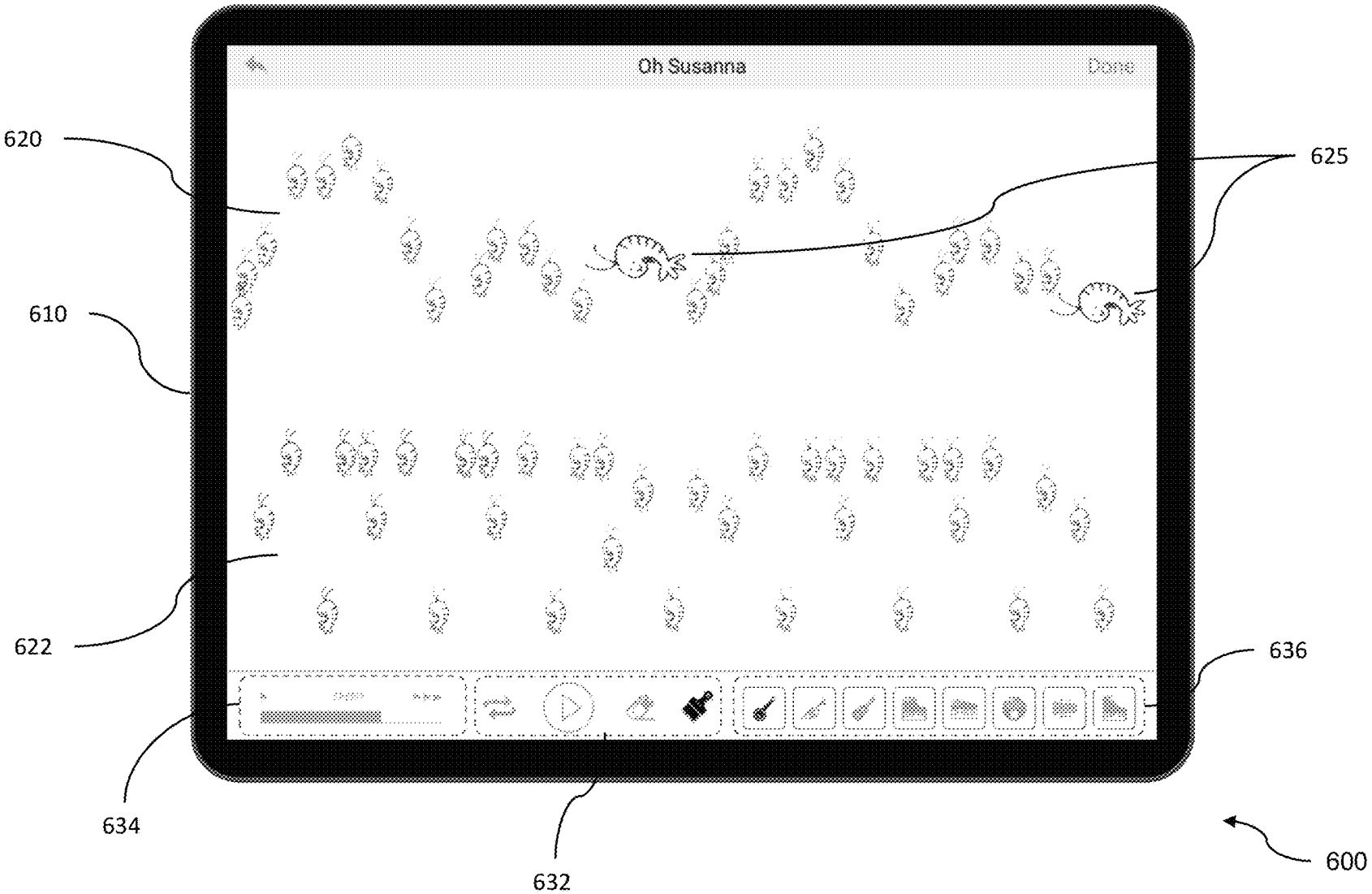
FIG. 6A shows an example music score with blanks transformed into the same certain, recognizable nature element.

FIG. 6A shows an example music score with blanks transformed into the same certain, recognizable nature element. The example 600 shows a digital canvas 610. The digital canvas 610 can include an upper set of blanks 620 and a lower set of blanks 622. Each set of blanks, or both sets of blanks, can be transformed into the same certain, recognizable nature element. In example 600, the same certain, recognizable nature element is a sea creature, namely a shrimp. The shrimp shape is thus an attribute of the blanks, and therefore, the shrimp shapes represent the musical tones and duration of a musical score, in this case, "Oh Susanna." While most shrimp shapes are the same size, a different size can be used to indicate particularly long tone durations, such as large shrimp 625, which can represent musical whole notes or musical shorter notes accompanied by an adjacent musical rest, which represents a cessation of tone production for a definite period of time.

The digital blank canvas 610 can include control interfaces for additional controls. For example, the additional controls can include an operating mode 632, for selection of what phase of input and/or playback the digital canvas is currently in, and controls for playback and tempo control 634. Additionally, controls for musical instrument attribution 636 can be included. For example, with the proper operating mode 632 selected, a musical instrument from the musical instrument attribution control 636 can be selected by touch, and then it can be dragged to any blank for attribution of that blank with the selected instrument. A plurality of attributes can be likewise conferred on a plurality of blanks. However, one or more of the attributes from the plurality of attributes can be hidden from display on the plurality of blanks. In the example 600, setting a tempo of the playing using playback and tempo control 634 can be made during playback on the 2D graphical interface. Setting a tempo can include linear adjustments to note duration. In embodiments, setting a tempo can include non-linear adjustments to note duration. The setting a tempo can include adjustments to note duration based on a clef selection. Additional controls (not shown) can be included for further attribution possibilities.

Figure 6B:
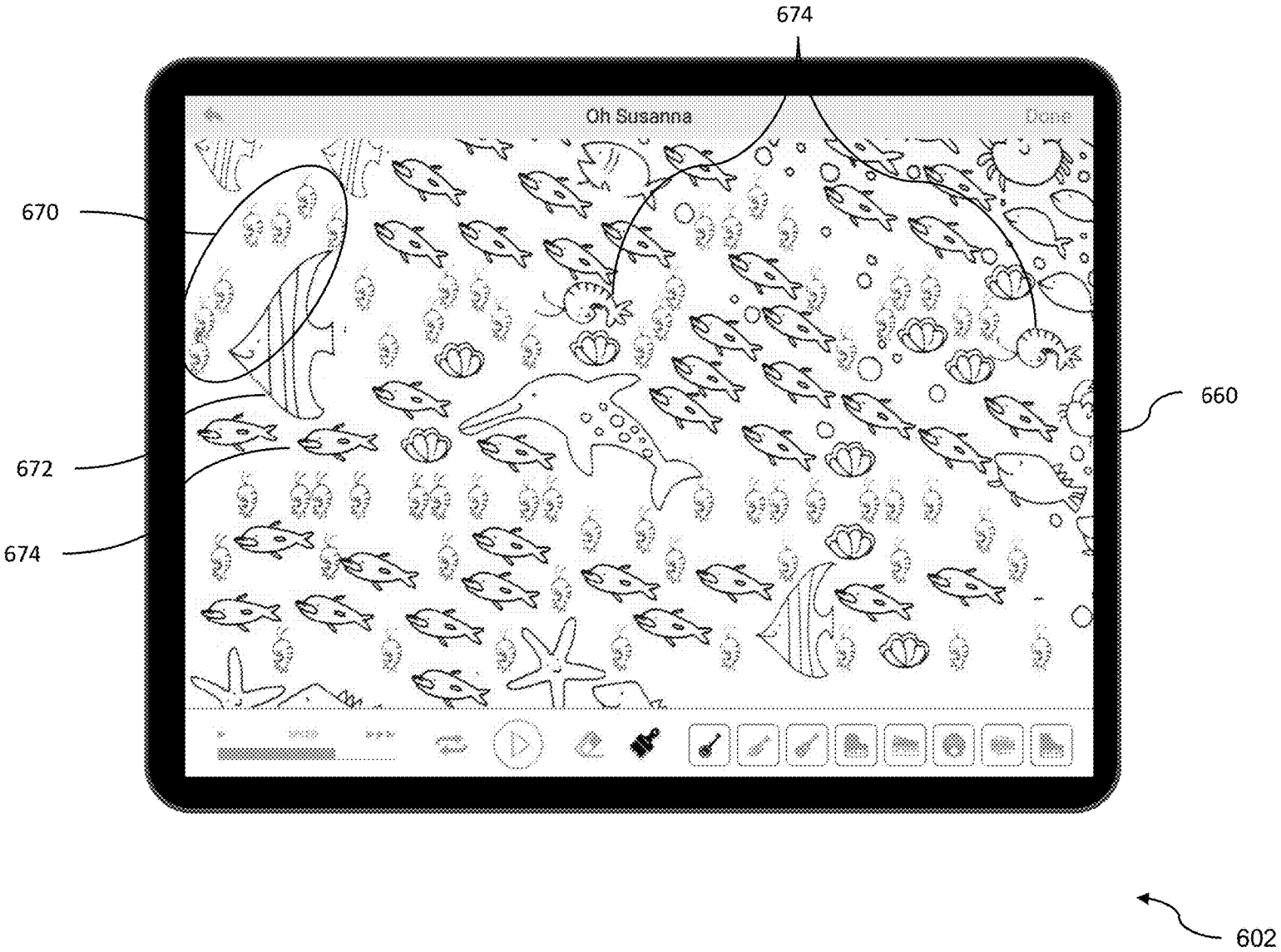
FIG. 6B shows an example music score with additional recognizable nature elements.

FIG. 6B shows an example music score with additional recognizable nature elements. Example 602 shows digital canvas 660 with upper set of blanks 620 (from FIG. 6A) and a lower set of blanks 622 (from FIG. 6A) transformed into shrimp shapes. However, in example 602, additional sea creatures 672 and 674 are included. The additional sea creatures 672 and 674 are not the shrimp selected as the certain, recognizable nature element. In example 602, different sea creatures are selected, but other, unrelated nature elements can be selected based on digital coloring book preferences. Some of the certain, recognizable nature elements, in this example, shrimp, are highlighted as shrimp grouping 670 and individual large shrimp (additional sea creature 674). Playback of the attributed blanks representing a musical score can be enabled by selecting, for example, the shrimp grouping 670 and one or more of the individual large shrimp 674. Adding additional recognizable nature elements into the 2D representation, such as sea creatures 672 and 674, can make the playback enabling selection process more challenging and more fun for a particular individual user, such as a child user. In embodiments, the blanks and the additional blanks are part of a pattern matching game. The correct blanks can be selected to play the intended music. In that manner the individual is rewarded, within a digital game, by hearing the desired music. In some embodiments, selection of shapes for the unrelated nature elements could not be selected or there could be some other feedback to the individual to select the patterns intended for the digital game.

Figure 7:
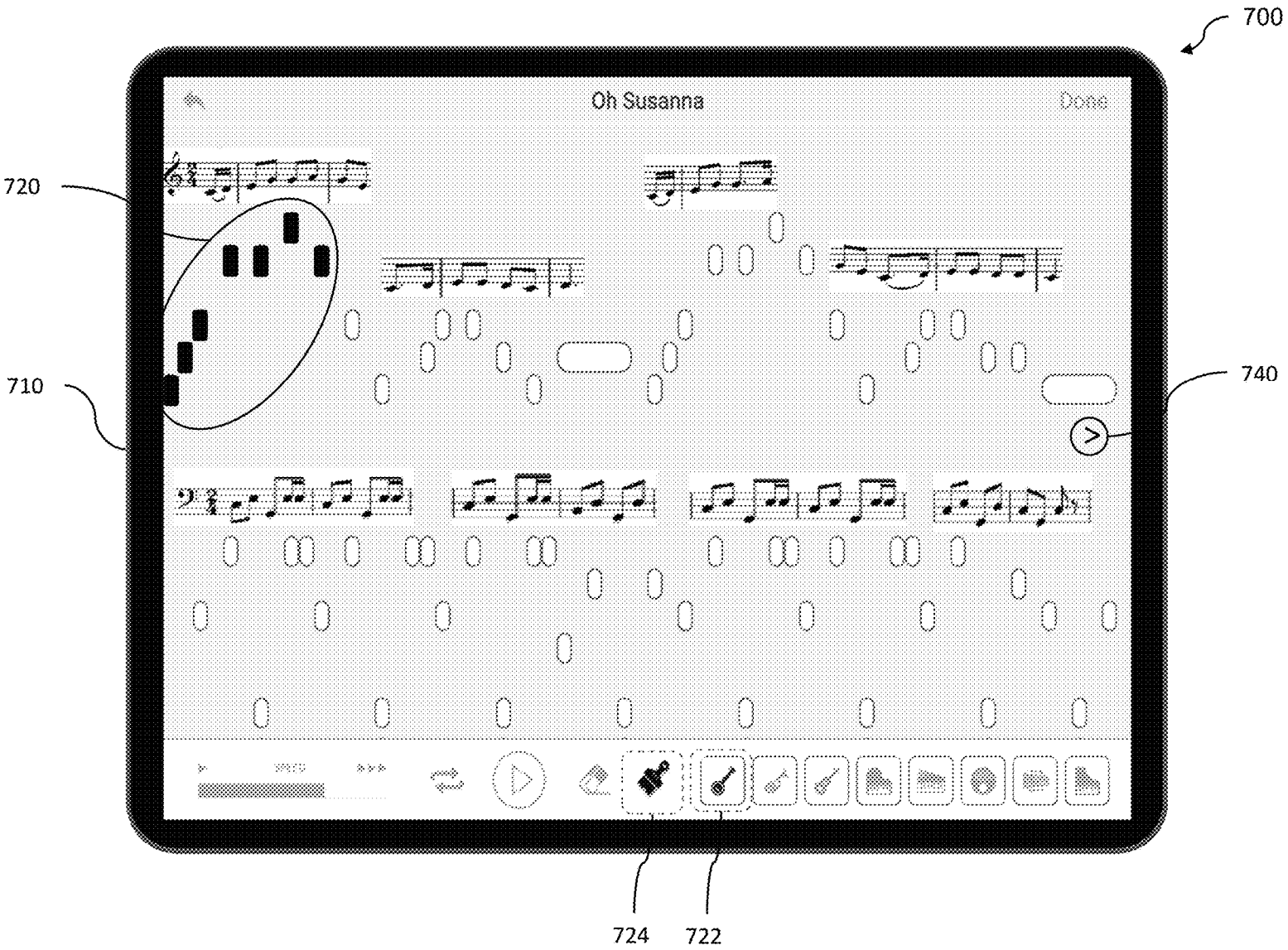
FIG. 7 illustrates an example partially filled-in digital canvas using an attributing instrument.

FIG. 7 illustrates an example filled-in digital canvas. The example 700 shows a filled-in digital canvas 710. The partially filled-in digital canvas 710 can include an upper set of filled-in blanks 720. The blanks 720 can be filled in using a musical instrument selection to control the timbre of the blank when played back. In example 700, banjo 722 is chosen as the musical instrument for attribution of one or more blanks. The attribution can include selecting the banjo 722 and then selecting each blank desired to be attributed with a banjo sound during playback. The selecting can be accomplished on a touch screen, for example, by touching the banjo 722 while in musical instrument attribution mode 724, also selected, for example, by touching the icon representing musical instrument attribution mode 724. Then, each blank subsequently selected will be attributed with the selected musical instrument. In example 700, banjo 722 is shown as being attributed to blanks 720 by virtual of their dark coloration.

A digital canvas, such as digital canvas 710, can be color-enabled, such that the attributing can include using a color to associate a musical instrument to the blank. Additionally, the hue of the color can correspond to the volume of the blank played in the musical score. The hue can include lightness and darkness of the color. By way of example, a series of blanks colored in yellow can indicate attribution with the sound of a grand piano. Similarly, blanks colored in purple can indicate attribution with the sound of a snare drum. A darker version of the color, or a deeper hue, can indicate a louder sound attributed to the instrument of those blanks. Continuing the example, a light yellow along with a dark green can indicate a quiet piano part along with a loud drum part. Conversely, a dark yellow along with a light green can indicate a loud piano part along with a quiet drum part. Because multiple instruments with multiple hues can make distinction of attribution difficult, an additional controls interface can be used to bring up different sub-palettes of musical instrument attribution controls (not shown) which can then be applied in various order to the plurality of blanks. Alternatively, the color can be represented by fill shapes instead of, or in addition to, color. The example 700 can include scrolling blanks from the plurality of blanks across a display of a digital device to accommodate elapsed time of the playing of the musical score as indicated by arrow 740.

Figure 8:
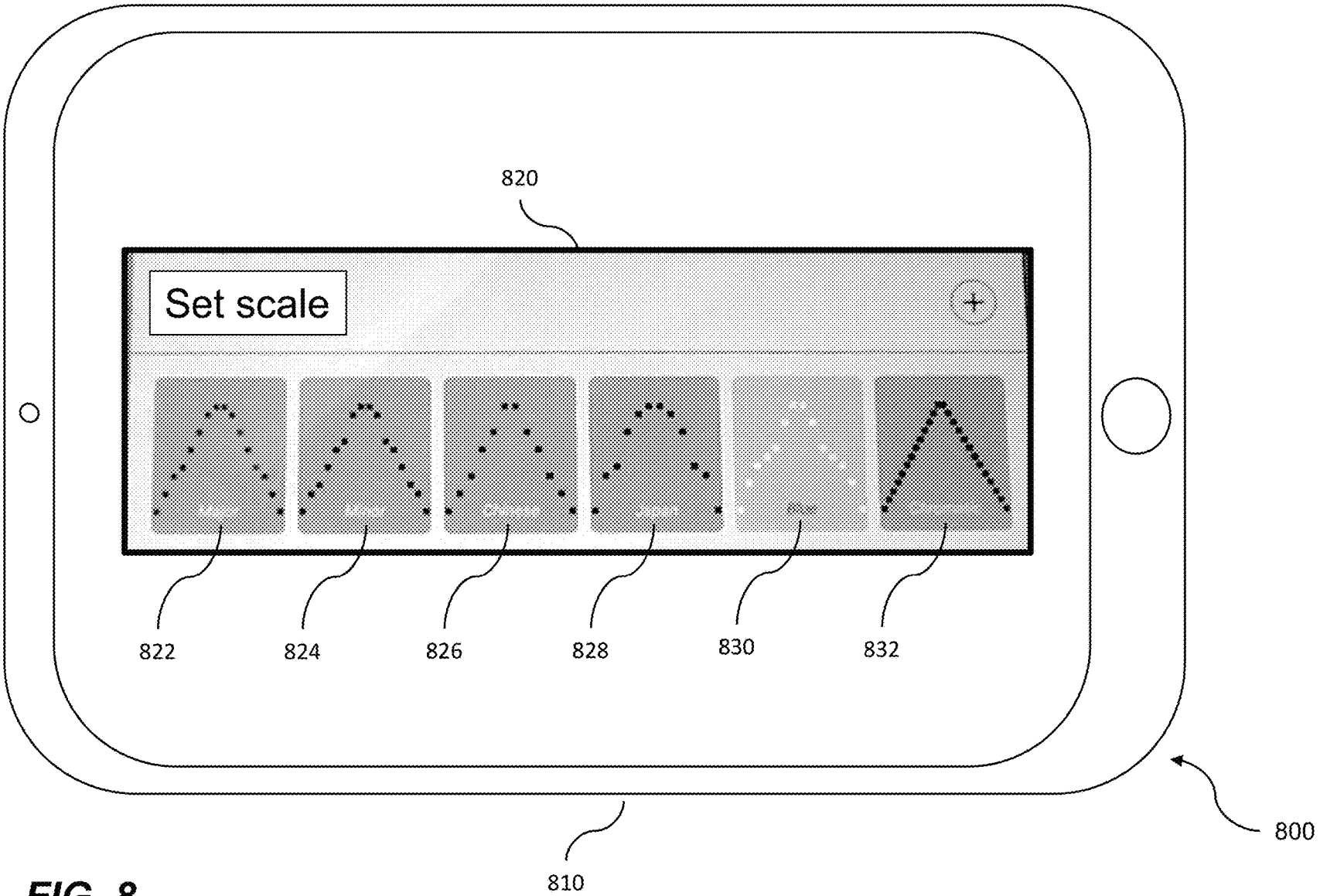
FIG. 8 shows an example scale selection GUI.

FIG. 8 shows an example scale selection GUI. The example 800 shows a digital device 810 displaying a scale selection GUI 820. The scale selection GUI 820 can comprise predefined scales such as a major scale 822, a minor scale 824, a Chinese scale 826, a Japanese scale 828, a Blues scale 830, a chromatic scale 832, and so on. The audio frequency can be determined by a scale selection. Therefore, the example 800 can include mapping the notes to a scale using the 2D graphical interface. The scale can be selected from a predefined set of scales. The predefined set of scales includes, but is not limited to, a major scale, a minor scale, a Chinese scale, a Japanese scale, a Blues scale, or a chromatic scale. Other scales can be provided, including a user defined or freeform scale. Thus in embodiments, the scale comprises a freeform definition of tones.

Because the digital canvas of blanks represents an abstraction of the traditional clef-based nomenclature, the selection of scale provides for the transformation of relative notes into absolute notes. As a concrete example, consider a tone using the so-called solfeggio scale of "do-re-mi" in which syllables are assigned to musical notes. The tone "mi" in a C-major scale would be an E-natural note, or about 330 Hz. However, when played in a C-minor scale, "mi" would become an E-flat note, or about 311 Hz. Thus it can be recognized that an abstracted blank tone can uniquely indicate multiple distinct pitches based on a scale selection. This dynamic flexibility of music attribution provides for widely varying sounds during playback which can be both educational and entertaining.

Figure 9:
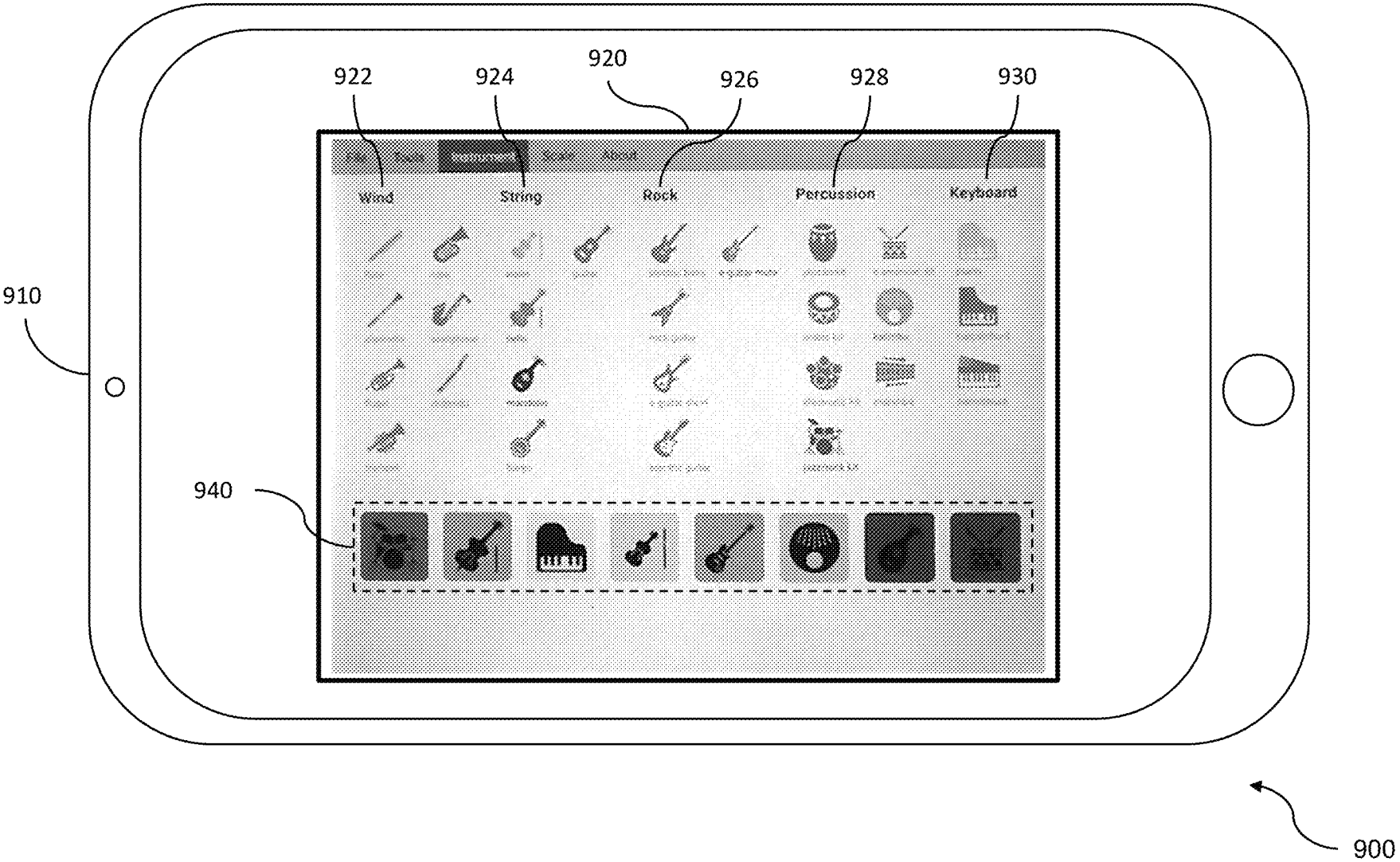
FIG. 9 shows an example detailed instrument selection GUI.

FIG. 9 shows an example detailed instrument selection GUI. The example 900 shows a digital device 910 displaying an instrument selection GUI 920. The instrument selection GUI 920 can comprise various categories of instruments such as woodwind instruments 922, string instruments 924, rock band instruments 926, percussion instruments 928, keyboard instruments 930, and so on. Instruments from the various categories 922, 924, 926, 928, and 930 can be selected and dragged to an instrument selection sub-palette 940, which can appear on, for example, the digital canvas 610 as the musical instrument attribution control 636. It can be recognized that a huge number of sub-palettes is available for musical instrument attribution of a plurality of attributes on a plurality of blanks. Dragging an instrument from the sub-palette to the blank and indicating a relative volume causes a hue of the appropriate color to appear in the blank. Thus the plurality of attributes can include musical instrumentation or volume.

Figure 10:
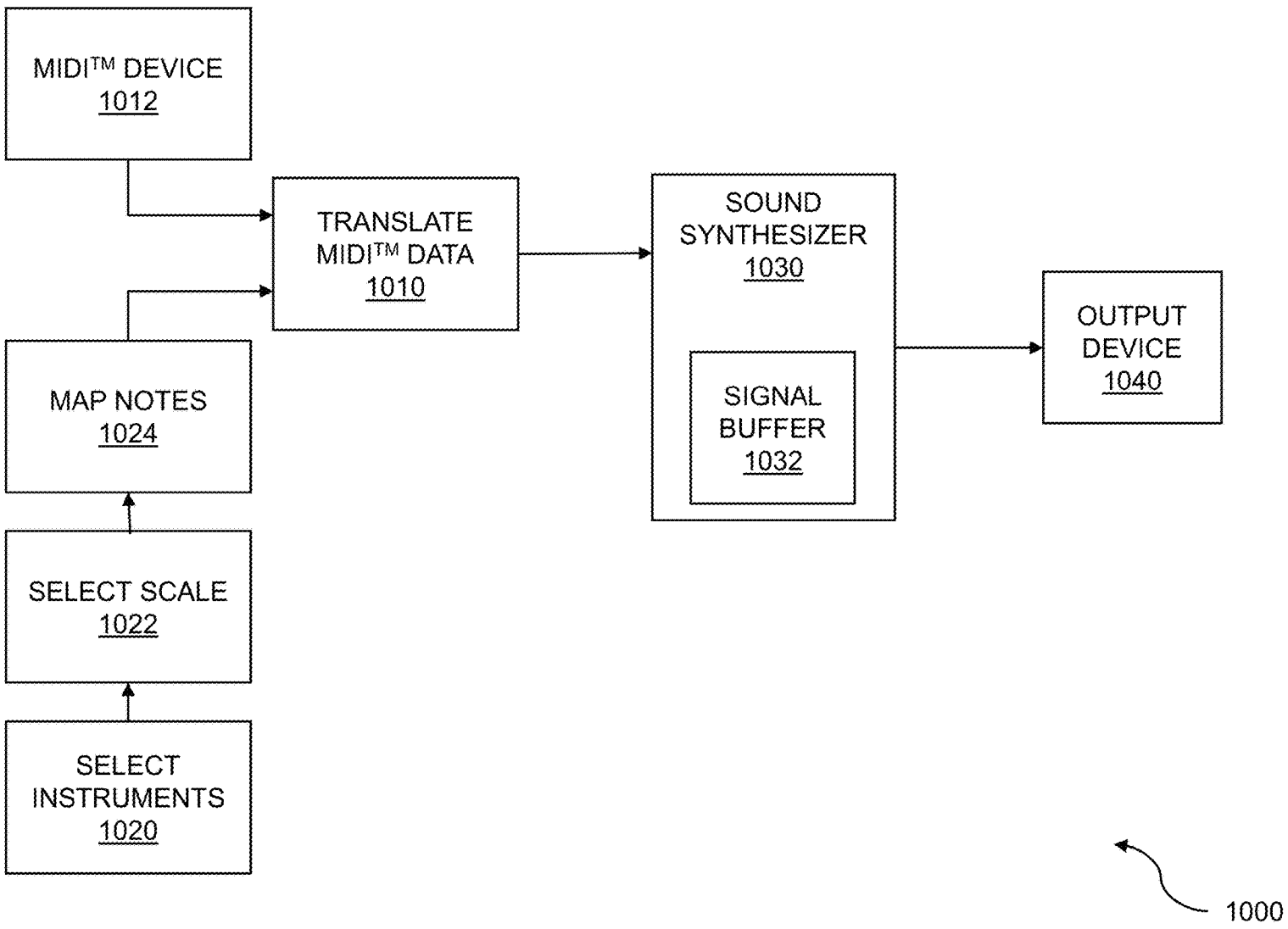
FIG. 10 is a subsystem block diagram for mapping, translating, and synthesizing sounds.

FIG. 10 is a subsystem block diagram for mapping, translating, and synthesizing sounds. The subsystem 1000 includes a MIDI™ device 1012 capable of providing MIDI™ notes to a MIDI™ data translator 1010, which translates the input MIDI™ notes based on the select instruments block 1020, the select scale block 1022, and the note mapping block 1024. As described above, the translated MIDI™ data would be different based on the mapping. The translated MIDI™ data is used by a sound synthesizer 1030 to provide notes of precise frequency and duration, aided by a signal buffer 1032 for synchronization and polyphonic purposes. The synthesized sound is converted to an audible tone using an output device 1040, such as an amplifier connected to speakers, earbuds, or the like. In the subsystem 1000, the playing the tone corresponds to an audio frequency. The subsystem 1000 includes changing scales for the musical score. Thus, the subsystem 1000 combines the 2D graphical music attribution and manipulation with the production of unique audio sounds created from an existing, inputted piece of music and modified by a user for educational, entertainment, and other purposes.

Figure 11:
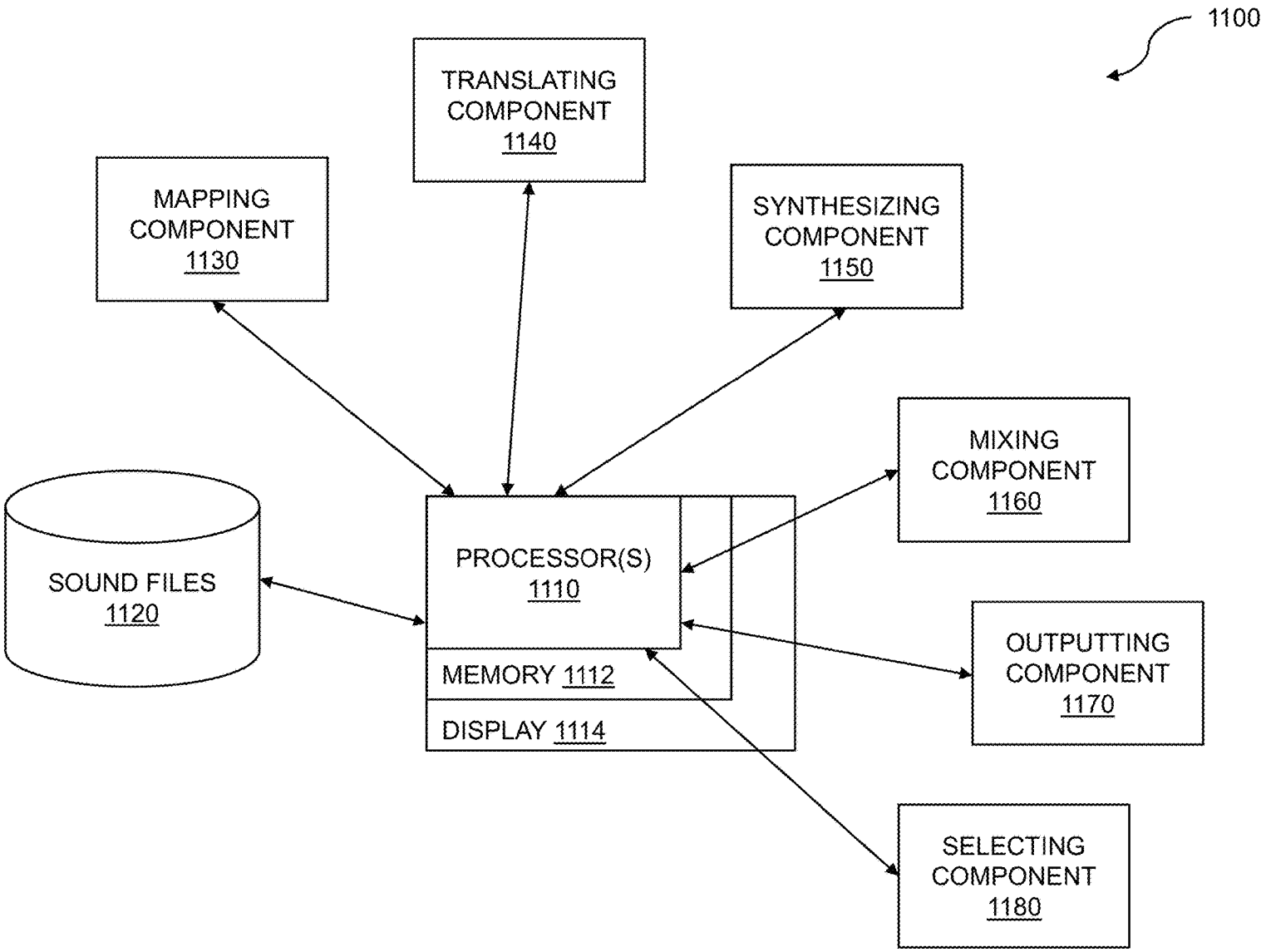
FIG. 11 is a system diagram for music synthesis.

FIG. 11 is a system diagram for music synthesis. The system diagram 1100 illustrates a computer system for graphical music manipulation. The system can include inputting sound files 1120. The sound files may be MIDI™ format or sheet music format or any other suitable input format for a music piece. The system can include a mapping component 1130 in which a user dynamically and interactively provides musical attributes to a modified input sound file. The attributes can include instrumentation, relative volume, tempo, scale, and so on. The system can include a translating component 1140 which takes mapped attributes and MIDI™ sounds and combines them to form a new MIDI™ sound file. The system can include a synthesizing component 1150. The synthesizing component produces digital sounds corresponding to the new, user-attributed sound file. The system can include a mixing component 1160 which provides for the synchronization of polyphonic sounds into a single digital audio representation. The system can include an outputting component 1170. The outputting component can convert the single digital audio representation into an amplified, analog audio signal used to drive an output device such as a speaker, earbuds, or the like. In embodiments, the outputting component 1170 converts the single digital audio representation into a MIDI™ file or stream for future or concurrent use. In embodiments, the outputting component 1170 outputs sheet music. The system can include a selecting component 1180. The selecting component 1180 can be accomplished on a 2D graphical representation GUI displayed on display 1114. Blanks can be abstracted to represent a sound file on the 2D graphical representation GUI. The blanks can be transformed into a series of shapes, each of which can be the same certain, recognizable nature element. The recognizable nature elements can be selected on the GUI to enable playback of the musical representation.

The computer system 1100 can include a memory 1112 which stores instructions and a display 1114. The computer system can include one or more processors 1110 attached to the memory 1112 wherein the one or more processors, when executing the instructions which are stored, are configured to: obtain a musical score; represent the musical score on a two-dimensional (2D) graphical interface, wherein the 2D graphical interface includes a plurality of notes represented by a plurality of blanks; attribute the musical score with one or more musical properties, wherein the one or more musical properties are associated with a first blank from the plurality of blanks; and play, using speakers coupled to the computing system, the musical score using the one or more musical properties associated with the first blank from the plurality of blanks. The system 1100 can include a computer program product embodied in a non-transitory computer readable medium for graphical music manipulation, the computer program product comprising code which causes one or more processors to perform operations of: obtaining, on a first digital device, a musical score; representing, on a second digital device, the musical score on a two-dimensional (2D) graphical interface, wherein the 2D graphical interface includes a plurality of notes represented by a plurality of blanks; attributing, on a third digital device, the musical score with one or more musical properties, wherein the one or more musical properties are associated with a first blank from the plurality of blanks; and playing, using speakers coupled to the third digital device, the musical score, wherein the playing is controlled using the one or more musical properties associated with the first blank from the plurality of blanks.

Each of the above methods may be executed on one or more processors on one or more computer systems. Embodiments may include various forms of distributed computing, client/server computing, and cloud based computing. Further, it will be understood that the depicted steps or boxes contained in this disclosure's flow charts are solely illustrative and explanatory. The steps may be modified, omitted, repeated, or re-ordered without departing from the scope of this disclosure. Further, each step may contain one or more sub-steps. While the foregoing drawings and description set forth functional aspects of the disclosed systems, no particular implementation or arrangement of software and/or hardware should be inferred from these descriptions unless explicitly stated or otherwise clear from the context. All such arrangements of software and/or hardware are intended to fall within the scope of this disclosure.

The block diagrams and flowchart illustrations depict methods, apparatus, systems, and computer program products. The elements and combinations of elements in the block diagrams and flow diagrams, show functions, steps, or groups of steps of the methods, apparatus, systems, computer program products and/or computer-implemented methods. Any and all such functions—generally referred to herein as a "circuit," "module," or "system"—may be implemented by computer program instructions, by special-purpose hardware-based computer systems, by combinations of special purpose hardware and computer instructions, by combinations of general purpose hardware and computer instructions, and so on.

A programmable apparatus which executes any of the above-mentioned computer program products or computer-implemented methods may include one or more microprocessors, microcontrollers, embedded microcontrollers, programmable digital signal processors, programmable devices, programmable gate arrays, programmable array logic, memory devices, application specific integrated circuits, or the like. Each may be suitably employed or configured to process computer program instructions, execute computer logic, store computer data, and so on.

It will be understood that a computer may include a computer program product from a computer-readable storage medium and that this medium may be internal or external, removable and replaceable, or fixed. In addition, a computer may include a Basic Input/Output System (BIOS), firmware, an operating system, a database, or the like that may include, interface with, or support the software and hardware described herein.

Embodiments of the present invention are neither limited to conventional computer applications nor the programmable apparatus that run them. To illustrate: the embodiments of the presently claimed invention could include an optical computer, quantum computer, analog computer, or the like. A computer program may be loaded onto a computer to produce a particular machine that may perform any and all of the depicted functions. This particular machine provides a means for carrying out any and all of the depicted functions.

Any combination of one or more computer readable media may be utilized including but not limited to: a non-transitory computer readable medium for storage; an electronic, magnetic, optical, electromagnetic, infrared, or semiconductor computer readable storage medium or any suitable combination of the foregoing; a portable computer diskette; a hard disk; a random access memory (RAM); a read-only memory (ROM), an erasable programmable read-only memory (EPROM, Flash, MRAM, FeRAM, or phase change memory); an optical fiber; a portable compact disc; an optical storage device; a magnetic storage device; or any suitable combination of the foregoing. In the context of this document, a computer readable storage medium may be any tangible medium that can contain or store a program for use by or in connection with an instruction execution system, apparatus, or device.

It will be appreciated that computer program instructions may include computer executable code. A variety of languages for expressing computer program instructions may include without limitation C, C++, Java, JavaScript™, ActionScript™, assembly language, Lisp, Perl, Tcl, Python, Ruby, hardware description languages, database programming languages, functional programming languages, imperative programming languages, and so on. In embodiments, computer program instructions may be stored, compiled, or interpreted to run on a computer, a programmable data processing apparatus, a heterogeneous combination of processors or processor architectures, and so on. Without limitation, embodiments of the present invention may take the form of web-based computer software, which includes client/server software, software-as-a-service, peer-to-peer software, or the like.

In embodiments, a computer may enable execution of computer program instructions including multiple programs or threads. The multiple programs or threads may be processed approximately simultaneously to enhance utilization of the processor and to facilitate substantially simultaneous functions. By way of implementation, any and all methods, program codes, program instructions, and the like described herein may be implemented in one or more threads which may in turn spawn other threads, which may themselves have priorities associated with them. In some embodiments, a computer may process these threads based on priority or other order.

Unless explicitly stated or otherwise clear from the context, the verbs "execute" and "process" may be used interchangeably to indicate execute, process, interpret, compile, assemble, link, load, or a combination of the foregoing. Therefore, embodiments that execute or process computer program instructions, computer-executable code, or the like may act upon the instructions or code in any and all of the ways described. Further, the method steps shown are intended to include any suitable method of causing one or more parties or entities to perform the steps. The parties performing a step, or portion of a step, need not be located within a particular geographic location or country boundary. For instance, if an entity located within the United States causes a method step, or portion thereof, to be performed outside of the United States then the method is considered to be performed in the United States by virtue of the causal entity.

While the invention has been disclosed in connection with preferred embodiments shown and described in detail, various modifications and improvements thereon will become apparent to those skilled in the art. Accordingly, the foregoing examples should not limit the spirit and scope of the present invention; rather it should be understood in the broadest sense allowable by law.

What is claimed is:

1. A computer-implemented method for graphical music manipulation comprising:

obtaining, on a first digital device, a musical score;

representing, on a second digital device, the musical score on a two-dimensional (2D) graphical interface, wherein the 2D graphical interface includes a plurality of notes represented by a plurality of blanks;

attributing, on a third digital device, the musical score with one or more musical properties, wherein the one or more musical properties are associated with a first blank from the plurality of blanks; and playing, using speakers coupled to the third digital device, the musical score, wherein the playing is controlled using the one or more musical properties associated with the first blank from the plurality of blanks.

2. The method of claim 1 wherein the two-dimensional (2D) graphical interface comprises a digital musical coloring book.

3. The method of claim 1 further comprising attributing the musical score with an additional one or more musical properties, wherein the additional one or more musical properties are associated with a second blank from the plurality of blanks.

4. The method of claim 3 further comprising playing the musical score using the one or more musical properties associated with the first blank and the additional one or more musical properties associated with the second blank.

5. The method of claim 1 wherein the blanks comprising the musical score have shapes of a first recognizable nature element.

6. The method of claim 5 wherein the first recognizable nature element is a plant or animal.

7. The method of claim 5 further comprising adding additional blanks in shapes of one or more additional recognizable nature elements.

8. The method of claim 7 wherein the additional blanks do not comprise a musical score.

9. The method of claim 7 further comprising enabling the playing by selecting the first recognizable nature elements.

10. The method of claim 9 further comprising disabling the playing by selecting one or more of the additional recognizable nature elements.

11. The method of claim 1 wherein the playing the musical score includes playing a duration of a blank from the plurality of blanks based on a size of the blank.

12. The method of claim 1 wherein the playing the musical score includes playing a tone of a blank from the plurality of blanks based on a vertical position of the blank.

13. The method of claim 12 wherein the playing the tone corresponds to an audio frequency.

14. The method of claim 13 wherein the audio frequency is determined by a scale selection.

15. The method of claim 1 wherein the playing the musical score includes playing a sequence of blanks from the plurality of blanks based on a horizontal position of the sequence of blanks.

16. The method of claim 15 wherein the sequence of blanks corresponds to note timing.

17. The method of claim 1 further comprising including a plurality of attributes on the plurality of blanks.

18. The method of claim 17 wherein the plurality of attributes includes duration, tone, and sequence.

19. The method of claim 1 further comprising setting a tempo of the playing using the 2D graphical interface.

20. The method of claim 1 wherein the first digital device and the second digital device are a common device.

21. The method of claim 1 wherein the second digital device and the third digital device are a common device.

22. A computer program product embodied in a non-transitory computer readable medium for graphical music manipulation, the computer program product comprising code which causes one or more processors to perform operations of:

obtaining, on a first digital device, a musical score;

representing, on a second digital device, the musical score on a two-dimensional (2D) graphical interface, wherein the 2D graphical interface includes a plurality of notes represented by a plurality of blanks;

attributing, on a third digital device, the musical score with one or more musical properties, wherein the one or more musical properties are associated with a first blank from the plurality of blanks; and playing, using speakers coupled to the third digital device, the musical score, wherein the playing is controlled using the one or more musical properties associated with the first blank from the plurality of blanks.

23. A computer system for graphical music manipulation comprising:

a memory which stores instructions;

one or more processors attached to the memory wherein the one or more processors, when executing the instructions which are stored, are configured to:

obtain a musical score;

represent the musical score on a two-dimensional (2D) graphical interface, wherein the 2D graphical interface includes a plurality of notes represented by a plurality of blanks;

attribute the musical score with one or more musical properties, wherein the one or more musical properties are associated with a first blank from the plurality of blanks; and play, using speakers coupled to the computing system, the musical score using the one or more musical properties associated with the first blank from the plurality of blanks.

* * * * *